US005233853A

United States Patent [19]

Milliman

[11] Patent Number: 5,233,853

[45] Date of Patent: Aug. 10, 1993

[54] STRETCH STRAIGHTENING HAIRPIN BENDER

[75] Inventor: James G. Milliman, Fawn River Township, St. Joseph County, Mich.

[73] Assignee: Burr Oak Tool & Gauge Company, Sturgis, Mich.

[21] Appl. No.: 816,827

[22] Filed: Jan. 3, 1992

[51] Int. Cl.[5] ..... B21D 3/12; B21D 53/06

[52] U.S. Cl. ..... 72/24; 72/294; 72/302; 72/307; 29/727

[58] Field of Search ..... 72/307, 306, 217, 302, 72/294, 23, 24; 29/726, 727

[56] References Cited

U.S. PATENT DOCUMENTS

| | | | |
|---|---|---|---|
| 2,449,507 | 9/1948 | Pope | 72/302 |
| 2,487,972 | 11/1949 | Katz | 72/302 |
| 3,686,921 | 8/1972 | Roper | 72/302 |
| 3,728,885 | 4/1973 | Ames | 72/294 |
| 3,922,901 | 12/1975 | Hillegas | 72/294 |
| 4,048,834 | 9/1977 | Durbin | 72/294 |

FOREIGN PATENT DOCUMENTS

| | | | |
|---|---|---|---|
| 875354 | 7/1971 | Canada | 72/307 |
| 168501 | 7/1934 | Switzerland | 72/302 |
| 2242380 | 10/1991 | United Kingdom | 72/302 |

*Primary Examiner*—Daniel C. Crane

*Attorney, Agent, or Firm*—Flynn, Thiel, Boutell & Tanis

[57] ABSTRACT

A device for sequentially stretched straightening a tube and bending same into a U-shape. The device includes a track for guiding a tube. A hold clamp is fixedly positioned on the track. A feed clamp is movably positioned on the track. A feed clamp is movably guided along the track between a first position adjacent the hold clamp and a second position at a stop mechanism. The stop mechanism is reciprocally shiftable along the track and is adapted to control the final increment of travel of the feed clamp during a movement thereof toward the second position. A tube cutting mechanism is oriented adjacent the hold clamp. A control activates the hold clamp to grip the tube while simultaneously effecting a movement of the feed clamp, when the clamping structure thereon is deactivated, away from the hold clamp toward the second position until it reaches the stop mechanism. Thereafter, the clamping mechanism on the feed clamp is activated to grip the tube and the feed clamp is moved to the second position thereof to cause the tube to be stretch straightened. The clamping mechanism on the feed clamp is deactivated following an arrival of the feed clamp at the second position to release the tension accumulated in the tube followed by a reactivation thereof and a deactivation of the clamping structure on the hold clamp.

17 Claims, 9 Drawing Sheets

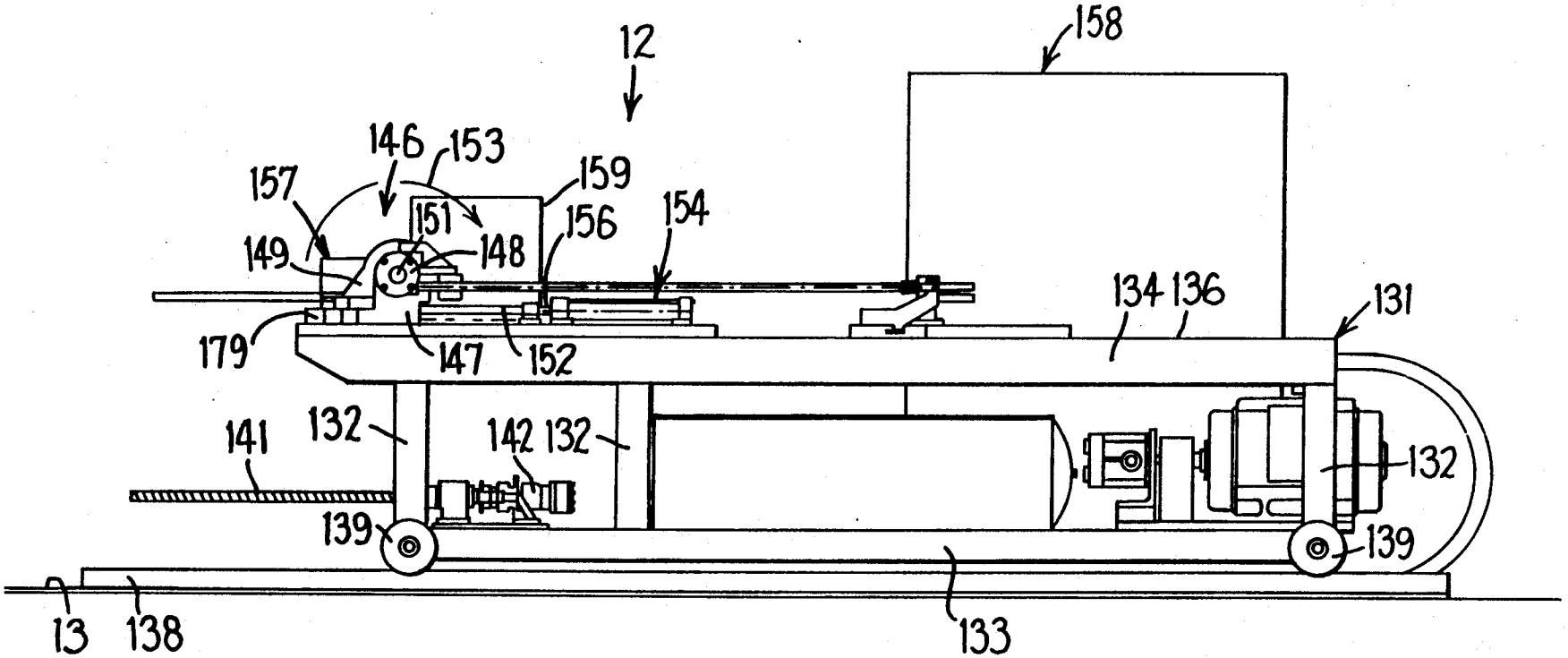
FIG. IB

STRETCH STRAIGHTENING HAIRPIN BENDER

FIELD OF THE INVENTION

This invention relates to a device for sequentially sizing an outer diameter of a tube, stretch straightening the tube and bending same into a U-shape.

BACKGROUND OF THE INVENTION

In the manufacture of heat exchanger coils, U-shape tubes are often used to form the fluid circuit in the heat exchanger. During the assembly of the heat exchanger, it is usually necessary to stack a plurality of thin, plate-like fins on stacker rods at the stamping press. The stack of fins is then removed from the stacker rods and placed on a lacing table and the U-shaped tubes or hairpins are then manually inserted or laced into the stack of fins. Oftentimes, the outer diameter of the legs of the U-shape tubes would be of varying diameters and/or oval in shape and were not completely straight. This resulted in diminished clearances and difficulty in the lacing of hairpins into fin holes. In many instances, it became difficult to control the degree of connection between the fins and the outer diameter of the U-shape tubes because of the widely varying tube diameters and/or shape of the legs in relation to the internal diameter of the holes punched in the fins.

Accordingly, it is an object of this invention to provide a combination tube straightening and tube bending device which enables the manufacture of a U-shape tube having precisely straight and generally parallel legs to enable hairpins to be conveniently laced into the fin stack.

It is a further object of this invention to provide a combination tube straightening and tube bending device, as aforesaid, wherein a tube sizing device is provided so that the outer periphery of the tube is rendered impeccably round, and the tube is straightened prior to its being bent into a U-shape.

It is a further object of this invention to provide a combination tube straightening and tube bending device, as aforesaid, wherein a plurality of tubes are simultaneously sized to the proper outer diameter, straightened and bent into a U-shape.

It is a further object of this invention to provide a combination tube straightening and tube bending device, as aforesaid, wherein the manufacture of the U-shape tubes occurs automatically with little or no supervision being required by operating personnel after the initial setup of the device.

It is a further object of this invention to provide a combination tube straightening and tube bending device, as aforesaid, wherein the length of the legs of the U-shape tube can be controlled during an initial setup of the device.

It is a further object of this invention to provide a combination tube straightening and tube bending device, as aforesaid, which is of a durable construction, easy to maintain and easy to operate.

SUMMARY OF THE INVENTION

The objects and purposes of the invention are met by providing a tube straightening and tube bending device which includes a frame on which is mounted a track for guiding at least one elongated continuous tube the length of the frame, the track having a tube entrance for the continuous length of tube at one end and a tube exit at the opposite end. A first tube holding structure is fixedly positioned on the frame adjacent the tube exit and has releasable clamping structure thereon for releasably gripping and fixedly holding the tube thereto. A second tube holding structure is movably guided along the track between a first position adjacent the first tube holding structure and a second position adjacent the tube entrance, the second tube holding structure having releasable clamping means thereon for releasably gripping and holding the tube thereto. A shiftable stop mechanism is provided at a third position for the second tube holding structure intermediate the first and second positions thereof. The stop mechanism is located in the path of movement of the second tube holding structure, is reciprocally shiftable along the track between the aforesaid second and third positions for the second tube holding structure, and is adapted to control the final increment of travel of the second tube holding structure during a movement of the second tube holding structure from the aforesaid third position toward the second position. A tube cutting mechanism is oriented adjacent the tube exit and the first tube holding structure and aligned with the track for severing the tube. The tube bending device is oriented adjacent the tube cutting mechanism and is aligned with the track. The tube bending device is also oriented on the side of the tube cutting mechanism remote from the first tube holding structure. Control means are provided (1) for facilitating an activation of the tube clamping mechanism on the first tube holding structure to grip and hold the tube thereto while simultaneously effecting a movement of the second tube holding means, when the clamping structure thereon is deactivated, toward the second position until contacting the stop means at the aforesaid third position thereof, (2) for activating the clamping mechanism on the second tube holding means while same is at the aforesaid third position to grip and hold the tube to the second tube holding structure, (3) for deactivating the shiftable stop means to allow it to be moved from the third position to the second position of the second tube holding structure and to allow for the movement of the second tube holding structure from the third position to the second position thereof, the tube being stretch straightened as the second tube holding structure is moved from the third position to the second position, (4) for deactivating of the clamping mechanism on the second tube holding structure following an arrival of the second tube holding structure at the second position to release the tension accumulated in the tube followed by a reactivation thereof and a deactivation of the clamping structure on the first tube holding structure and effecting a movement of the second tube holding structure toward the first position causing the tube to exit the track and enter the tube bending mechanism whereby the tube cutting mechanism severs the tube followed by the tube bending mechanism effecting a bending of the tube, whereupon the tube straightening and tube bending device is positioned for another cycle of operation.

BRIEF DESCRIPTION OF THE DRAWINGS

Other objects and purposes of this invention will be apparent to persons acquainted with apparatus of this general type upon reading the following specification and inspecting the accompanying drawings, in which:

FIG. 1B is a side elevational view of the tube bending mechanism of the combination tube stretch straightening and tube bending device;

DETAILED DESCRIPTION

Figure 1A:
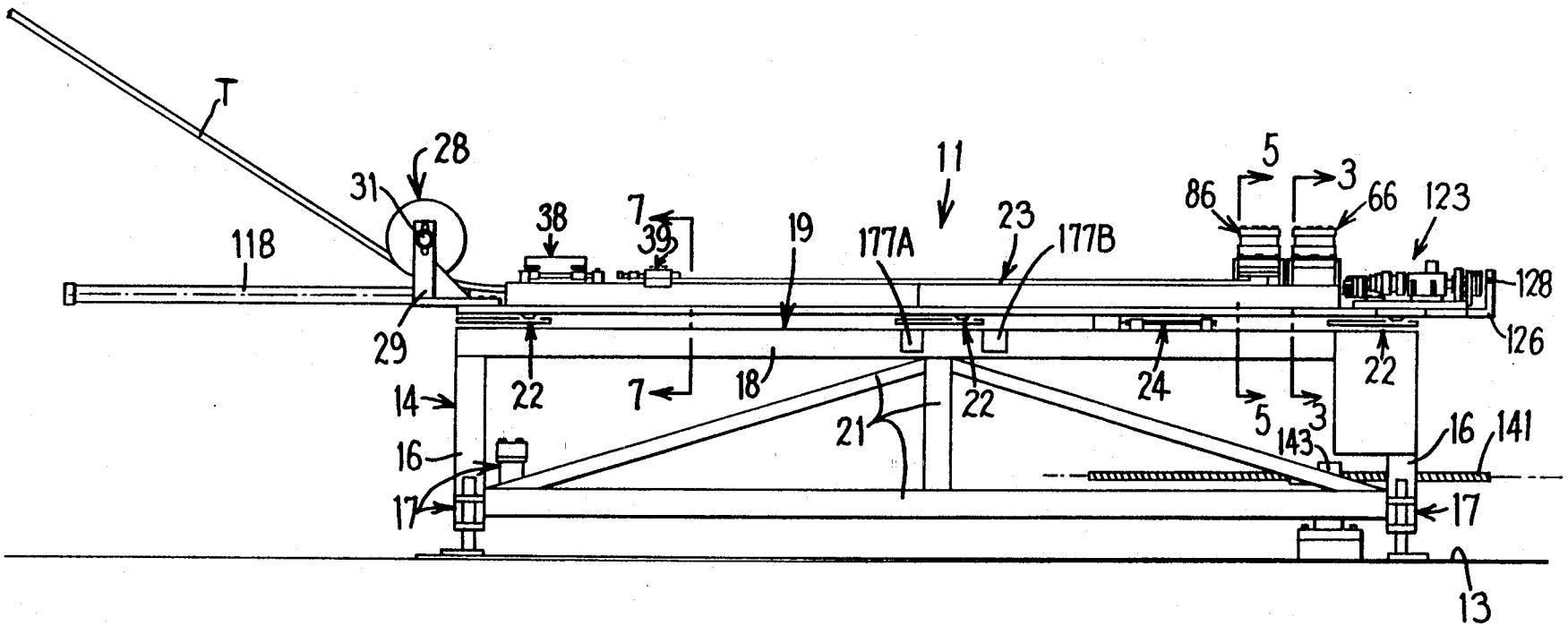
FIG. 1A is a side elevational view of the tube stretch straightening mechanism of the combination tube stretch straightening and tube bending device.

Certain terminology will be used in the following description for convenience in reference only and will not be limiting. The words "up" and "down", "right" and "left" will designate directions in the drawings to which reference is made. The words "forward", "upstream" and "rearward", "downstream" will reference directions relative to the direction of movement of tubing through the device, "rearward" and "upstream" being to the left in FIGS. 1A-2B and "forward" and "downstream" being to the right in FIGS. 1A-2B. The words "in" and "out" will refer to directions toward and away from, respectively, the geometric center of the device and designated parts thereof. Such terminology will include derivatives and words of similar import.

Figure 2A:
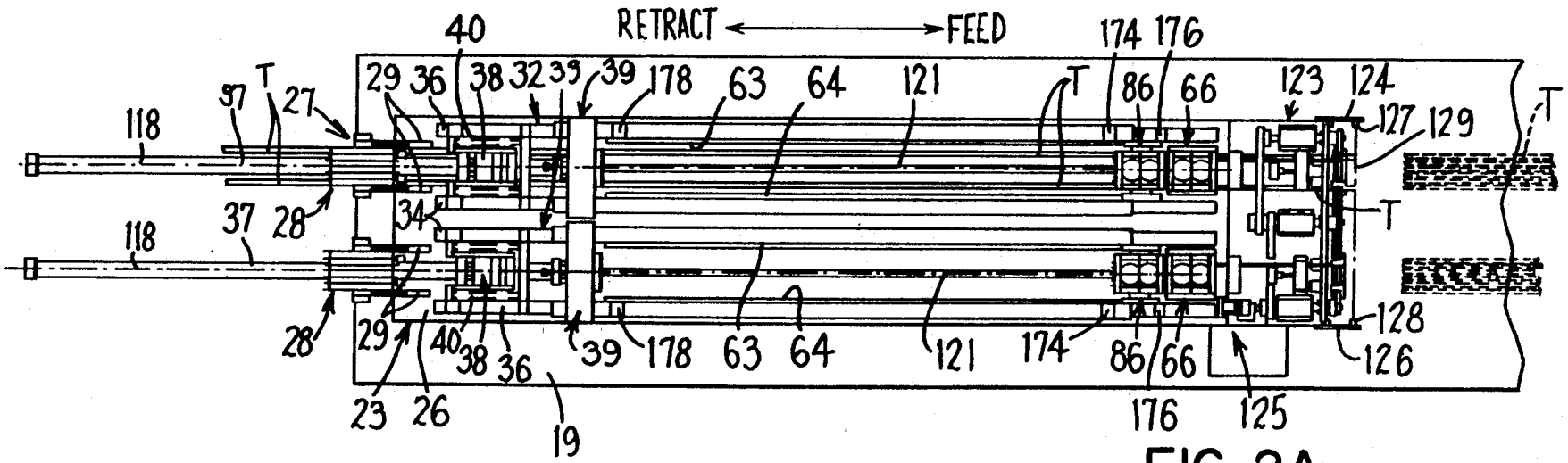
FIG. 2A is a top view of the structure illustrated in FIG. 1A.
Figure 2B:
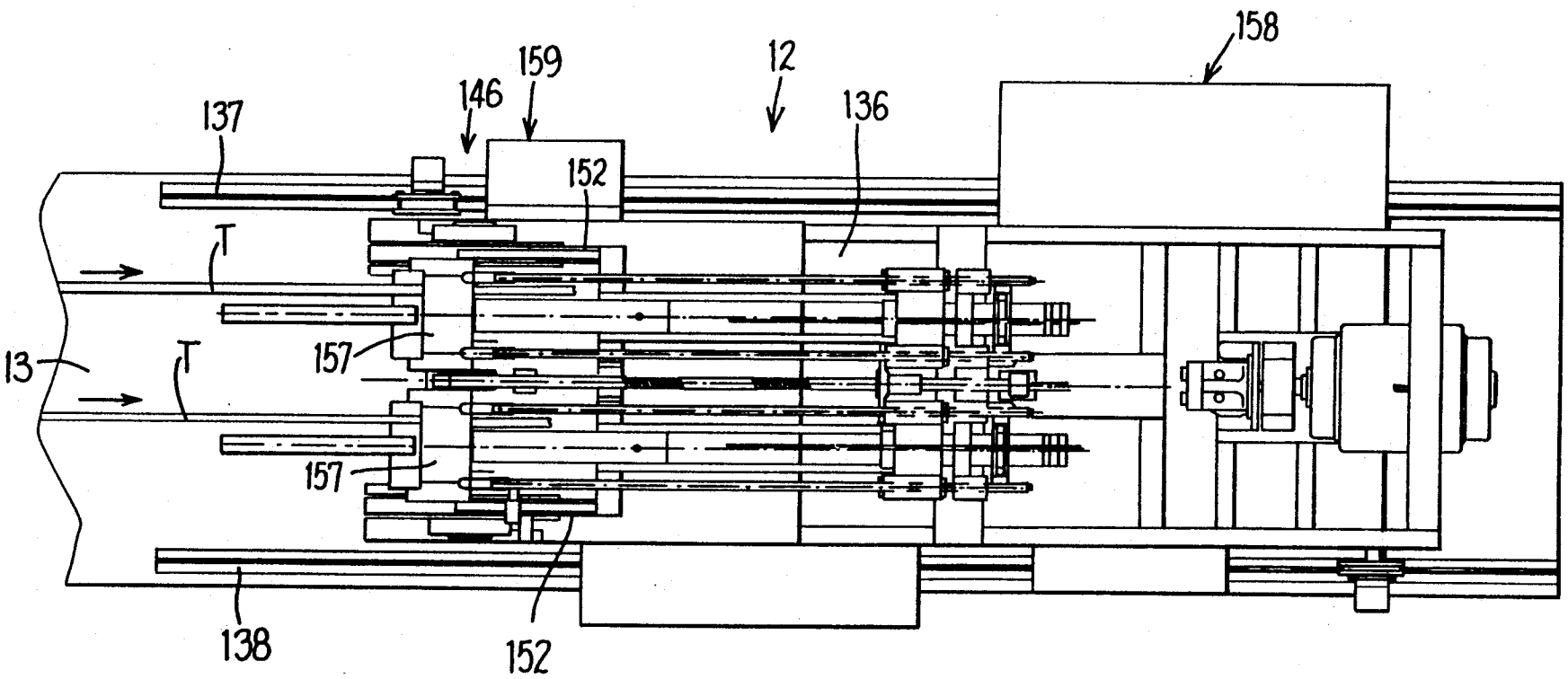
FIG. 2B is a top view of the structure illustrated in FIG. 1B.

A tube stretch straightening and tube bending device 10 is shown in FIGS. 1A-2B and includes a tube stretch straightening mechanism 11 illustrated in FIGS. 1A and 2A oriented at the same level and to the left of a tube bending mechanism 12 illustrated in FIGS. 1B and 2B. The tube stretch straightening mechanism 11 and the tube bending mechanism 12 can be mounted, if desired, on a common support platform 13 or a level floor surface. The tube stretch straightening mechanism 11 includes a table-like frame 14 having a plurality of legs 16 resting on the upper surface of the support platform 13. A conventional motorized adjusting mechanism 17 is provided for facilitating a vertical adjustment of the table-like frame 14 as well as enabling the table-like frame to be oriented in a horizontally level condition if the support platform 13 is not used and the floor on which the frame 14 is mounted is not level. The table-like frame 14 includes a frame member 18 supported by the legs 16 and has an upwardly facing mounting surface 19 thereon. Conventional bracing structure 21 is provided for interconnecting the legs 16 to the underside of the frame member 18 to maintain the mounting surface 19 on the frame member 18 in a stable-horizontally aligned position.

A plurality of guides 22 are mounted on the mounting surface 19. The longitudinal axes of the guides 22 are preferably axially aligned and extend parallel to the mounting surface 19. A carriage 23 is mounted on the guides 22 and is supported for movement to the left and to the right as illustrated in FIG. 1A by the guides 22. A fluid cylinder assembly 24 is mounted on the mounting surface 19 and includes a piston rod (not illustrated) connected to the underside of the carriage 23 for forcibly driving the carriage 23 leftwardly and rightwardly as illustrated in FIG. 1A.

In this particular embodiment, the carriage 23 includes a platform 26 (FIG. 2A) on which is mounted, at one end, hereinafter referred to as the entrance end 27, a pair of tube guiding rollers 28, each roller being adapted to accommodate a plurality of tubes, here six tubes, in a side-by-side orientation. The tube guiding rollers 28 are supported by a support bracket 29 each fixedly secured to the upper surface of the platform 26 by any conventional means. The tube guiding rollers 28 are rotatable about aligned axles 31.

A pair of tracks, generally indicated at 32 and 33, are mounted on the upper surface of the platform 26 and are oriented so that they extend parallel to each other. Further, the tracks 32 and 33 are a mirror image of one another. Since each track is identical to and a mirror image of the other, only one track will be described in detail, but the same reference numbers will be used to designate components of both tracks. Each track 32 and 33 includes a pair of parallel extending and laterally spaced rails 34 and 36. Each rail 34 and 36 is preferably equally spaced from and on laterally opposite sides of a longitudinal axis 37 that extends lengthwise of the platform 26 and is oriented parallel to the longitudinal axis of the guides 22. In other words, the carriage 23 is supported for movement in a direction that is parallel to the longitudinal axis 37 of the tracks 32 and 33. Further, and as shown in FIG. 2A, the tube guiding rollers 28 at the entrance end 27 are centrally disposed relative to the longitudinal axis 37.

A conventional tube outer diameter sizing die 38 is mounted adjacent the entrance end 27 to each of the tracks 32 and 33. The tube sizing dies 38 are of a conventional construction and allow for an elongated continuous tube from a coil (not shown) to pass through passageways therein to reduce the outer diameter of the tubes to a precise and selectably controlled outer diameter as the tubes move through the dies. In this particular embodiment, the sizing dies are each movably supported on guide rods 40 for movement parallel to the longitudinal axis 37.

Figure 8:
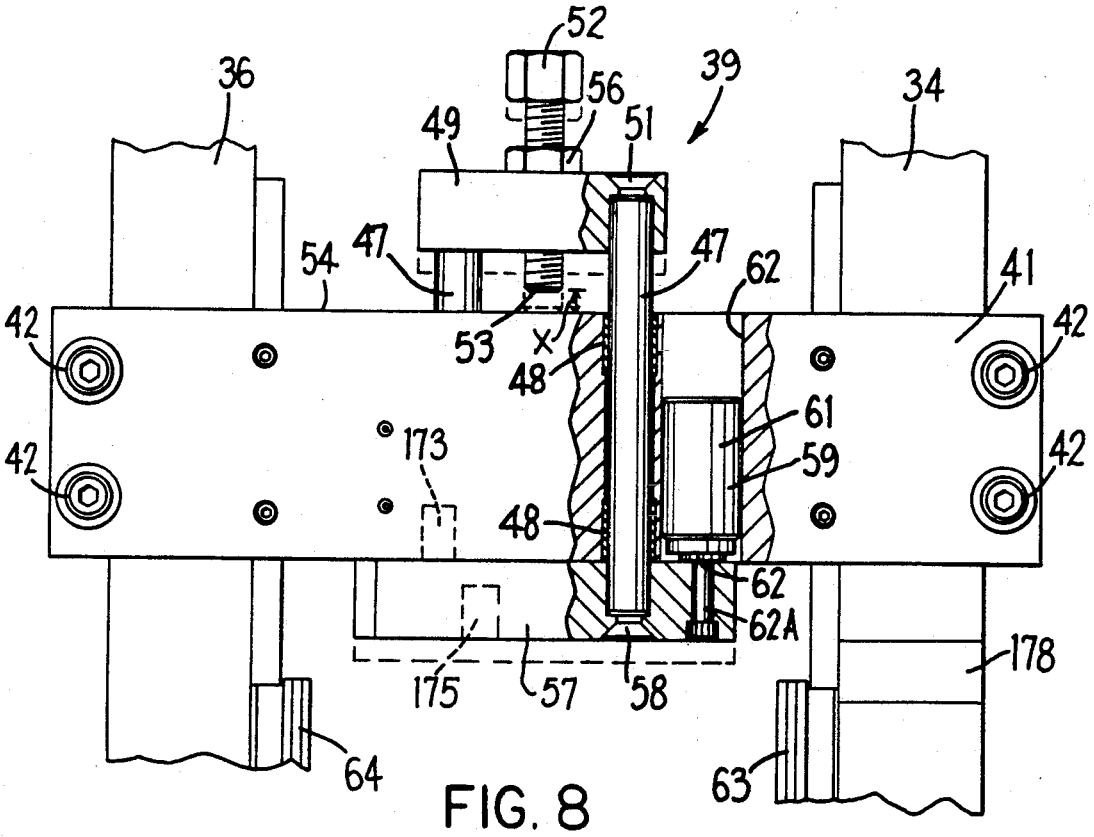
FIG. 8 is a partially sectioned top view of FIG. 7.

A stop mechanism 39 is oriented on each track 32 and 33 to the right of the tube sizing dies 38. The position of the stop mechanism 39 along the tracks 32 and 33 is selectable. When the position of the stop mechanism 39 has been determined, appropriate securement structure is provided in order to fixedly orient the stop mechanism to each track 32 and 33. More specifically, and referring to FIGS. 7 and 8, each stop mechanism 39 includes a transversely extending plate 41 secured by a plurality of screws 42 to each of the rails 34 and 36. As shown particularly well in FIG. 7, the screws 42 are received in a jaw 43 which has a lip 44 extending beneath a laterally extending shoulder 46 on the rails 34 and 36. Thus, upon a tightening of the screws 42, the jaws 43 will be elevated so that the lips 44 will move into clamping relationship with the shoulders 44 to fixedly orient the stop mechanisms 39 relative to each track 32 and 33. A pair of rods 47 (FIG. 8) are reciprocally supported on the plate 41 in bushings 48 and in a direction parallel to the longitudinal axis 37. A plate 49 is secured as by screws 51 to one end of each of the rods 47 and includes an adjustment screw 52, the end 53 of which screw is movable into and out of engagement with a side wall surface 54 on the plate 41 in response to reciprocal movement of the rods 47 relative to the plate 41. The spacing X between the surfaces 53 and 54, when the rods 47 are at one end of their range of movement, can be controlled by rotating the screw 52 relative to an internally threaded hole in a plate 49, a nut 56 being provided to lock the screw 52 to the plate 49 after adjustment. A further plate 57 is secured to the other ends of the rods 47 and by screws 58. As shown in FIG. 8, the plate 57 is on a side of the plate 41 remote from the plate 49. A power cylinder assembly 59 includes a cylinder 61 mounted on the plate 41 in an opening 62 provided therefor. The power cylinder assembly 59 also includes a reciprocally drivable rod 62 fixedly secured to the plate 57 by a screw 62A. Thus, when the power cylinder assembly 59 is appropriately activated, the plate 57 will be driven reciprocally between the solid line position and the broken line position illustrated in FIG. 8. The purpose of the stop mechanisms 39 will be explained in further detail below.

Figure 7:
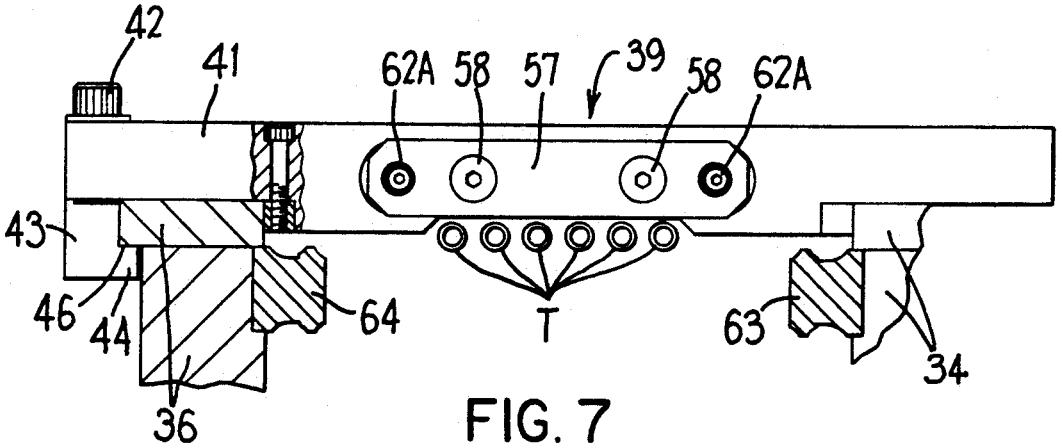
FIG. 7 is a sectional view taken along the line 7—7 of FIG. 1A.

As shown in FIGS. 7 and 8, a set of straight guide tracks 63 and 64 are secured to the opposing surfaces on the rails 34 and 36, respectively. The securement can be effected by any convenient means, as by screws not illustrated. Thus, and in this particular embodiment, the stop mechanism 39 is oriented at one end of the guide tracks 63 and 64; but it can be oriented at any location along the guide tracks 63, 64, depending on the desired length of the legs of the hairpin T.

Figure 4:
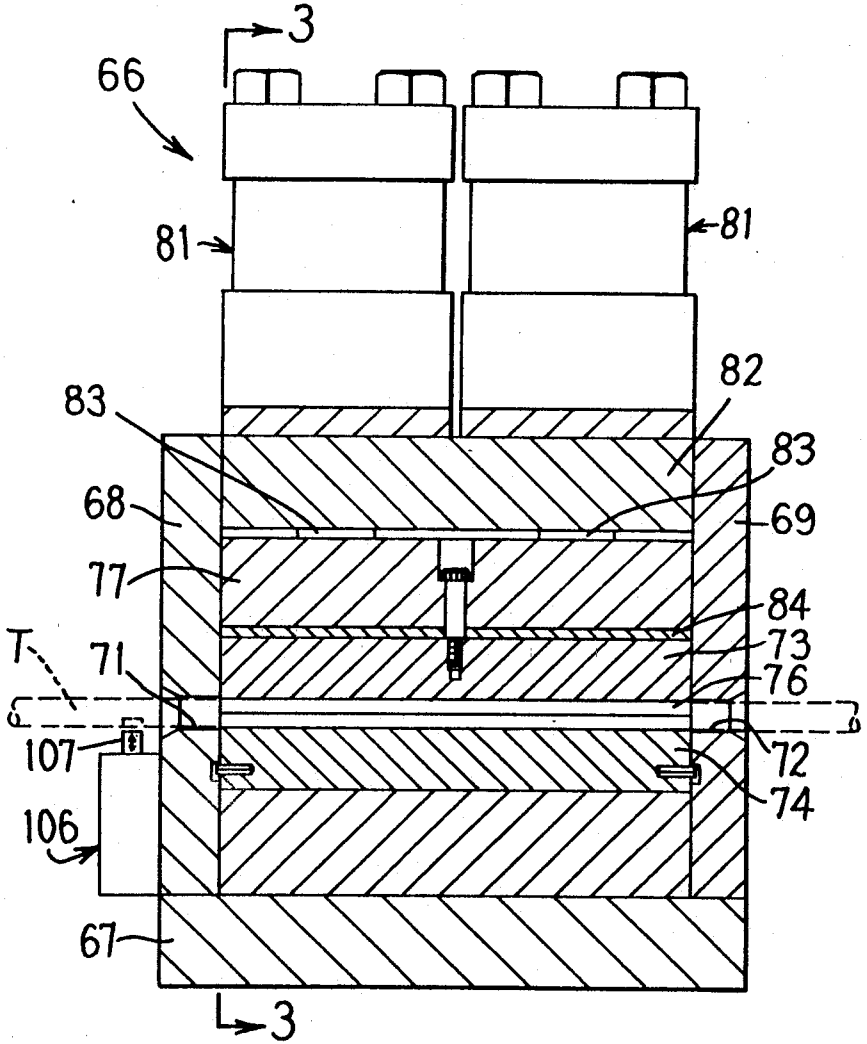
FIG. 4 is a sectional view taken along the line 4—4 of FIG. 3.
Figure 3:
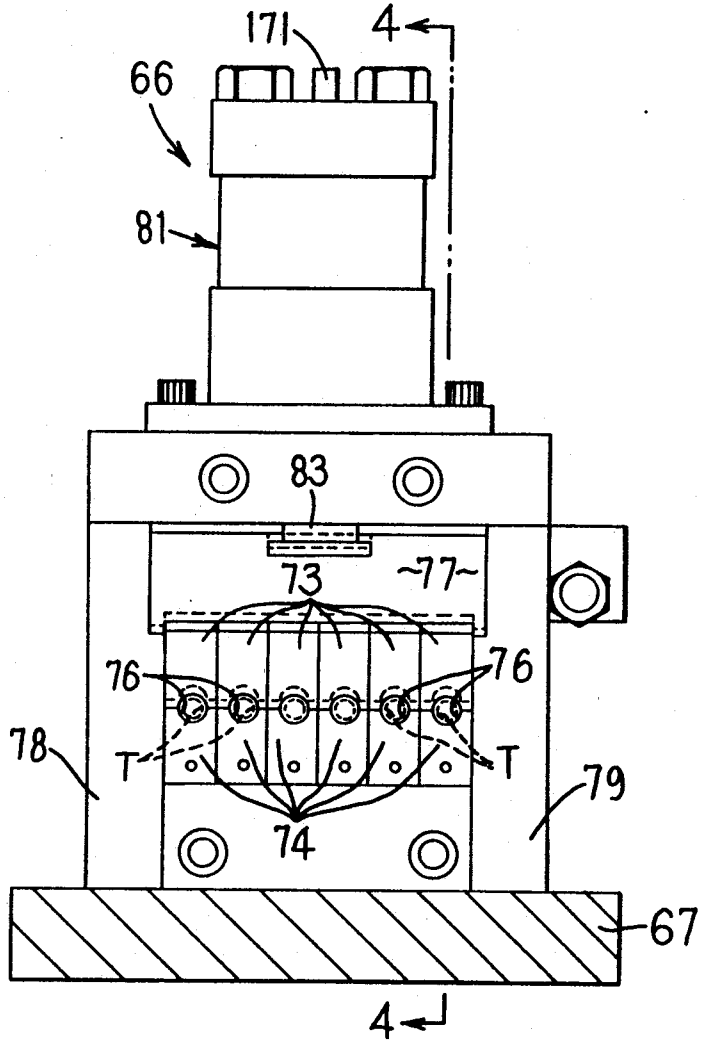
FIG. 3 is a sectional view taken along the line 3—3 of FIGS. 1A and 4.

A first tube clamping or holding device 66 (also referred to as a hold clamp) is secured to the table top 23 (FIG. 2A) at an end of the guide tracks 63 and 64 remote from the stop mechanism 39 on each track 32 and 33 as best illustrated in FIG. 2A. Referring to FIGS. 3 and 4, each first tube clamping device 66 includes a base plate 67 on which is mounted on a pair of upstanding side plates 78, 79 and front and rear plates 68 and 69 (FIG. 4), both of which front and rear plates have axially aligned openings 71 and 72, respectively, extending on axes parallel to the longitudinal axis 37 and adapted to receive therethrough tubing T. Between the upstanding front and rear plates 68 and 69, and as also shown in FIG. 4, are clamping blocks 73 and 74, the individual clamping blocks 74 being interchangeably removably secured within the structure defined by the upstanding front and rear plates and side plates 68, 69, 78, 79. The clamping blocks 73 are vertically movable relative to the clamping block 74. Each clamping block 73 and 74 have a plurality of semicircular grooves therein which, when the clamping block 73 engages with the clamping block 74 as shown in FIG. 4, forms a circular opening 76 extending between the plurality of axially aligned opening 71 and 72 and the upstanding plate 68 and 69. As shown in FIG. 3, the clamping blocks 73 and 74 can be comprised of multiple components each adapted to mate with each other to form the circular openings 76. A common block 77 is coupled to each of the clamping blocks 73, which common block 77 is supported for vertical movement between the upstanding plate 68 and 69 as well as side plates 78 and 79 shown in FIG. 3. In order to uniformly apply the requisite amount of force to the entire length of each of the clamping blocks 73, a pair of power cylinder assemblies 81 are mounted on a top wall 82 of the first tube clamping device 66. Each power cylinder assembly 81 has a reciprocal piston rod 83 (see FIG. 3) thereon attached by any convenient means not illustrated to the common block 77 to effect a reciprocal movement of the common block 77. The clamping blocks 73 and 74, when in the engaged position illustrated in FIGS. 3 and 4 effectively clamp tubing T within the circular openings 76 and prevent the tubes T from moving in an axial direction thereof. Moving the clamping blocks 73 to the broken line position illustrated in FIG. 3 effects the release of the engagement with the tubing T and allows the tubes to move relative to the first tube clamping device 66. If desired, an equalizer pad 84 can be placed between the common block 77 and each of the individual clamping blocks 73 in order to ensure an equalized force applied by the piston rod 83 to each of the clamping blocks 73 through the common blocks 77.

It may occur that the tube T will become locked into the first tube clamping device 66 such that when the clamping block 73 moves away from the clamping block 74, the tube T will still be clamped or locked to the clamping block 74. In order to effect a release of the tube T from it engagement with the clamping block 74, an ejector mechanism 106 is provided and is schematically indicated in FIG. 4. The ejector mechanism 106 is fastened to the upstanding plate 68 and includes a reciprocal ejector pin 107 that is normally spaced away from the tube T. When it is desired to eject the tube T from its wedged in engagement with the clamping block 74, the ejector pin 107 is extended to knock the tube T out of its engagement with the clamping block 74. If desired, a single ejector mechanism can be provided, which ejector. mechanism has a crosswise extending plate thereon with multiple pins adapted to simultaneously engage the side-by-side oriented tubes T received in each of the openings 76 in the first tube clamping device 66.

Figure 6:
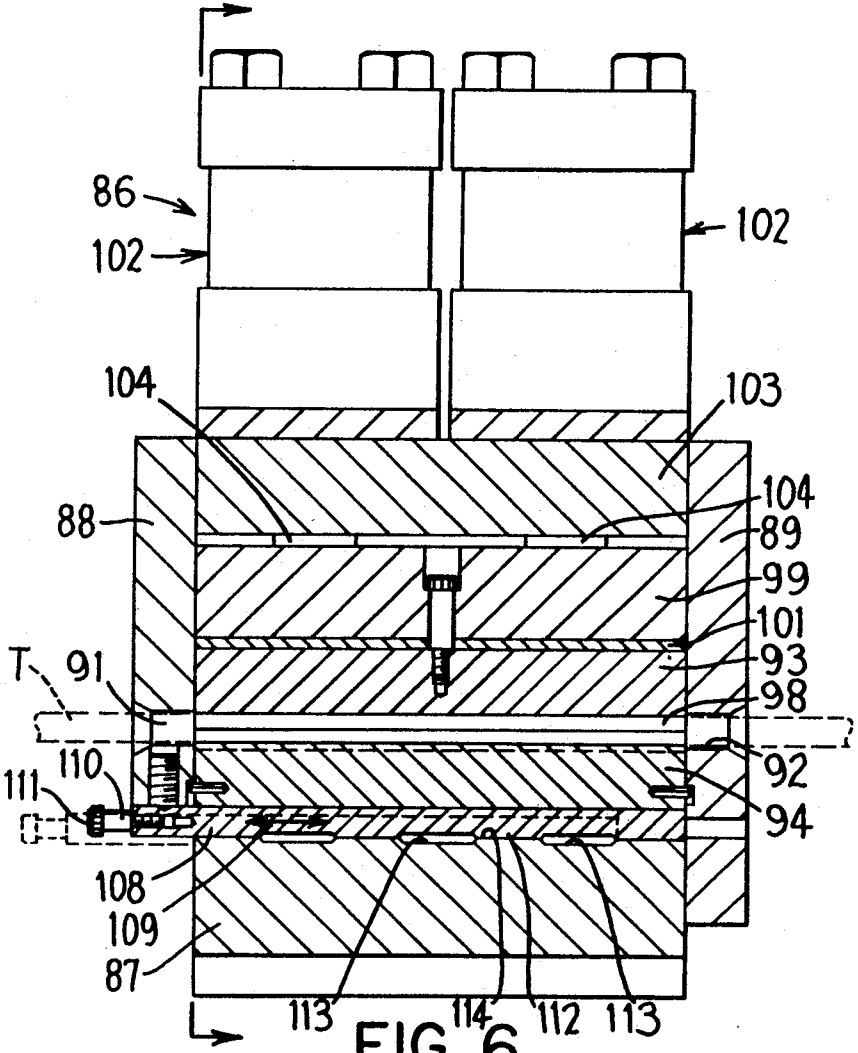
FIG. 6 is a sectional view taken along the line 6—6 of FIG. 5.
Figure 5:
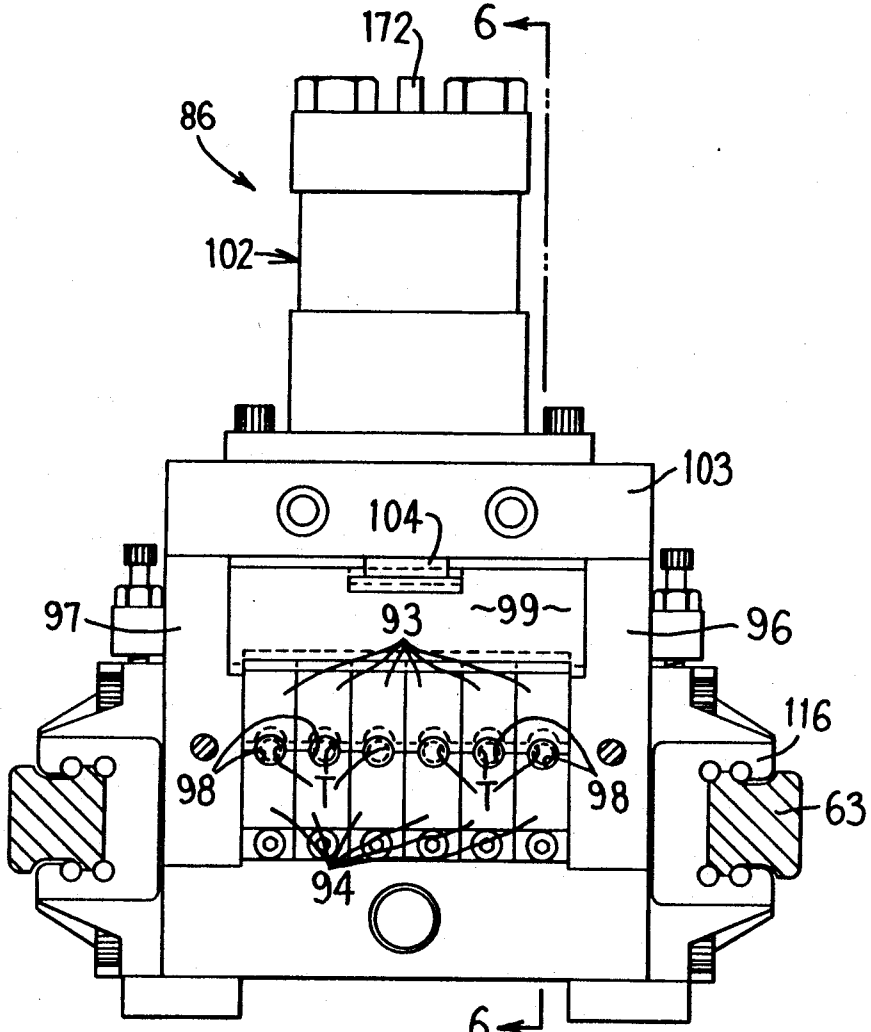
FIG. 5 is a sectional view taken along the line 5—5 of FIGS. 1A and 6.

A second tube clamping device 86 (also referred to as a feed clamp) is oriented intermediate the stop mechanism 39 and the first tube clamping device 66 as shown in FIGS. 1A and 2A. In many respects, the second tube clamping device 86 is similar to the first tube clamping device 66. More specifically, the second tube clamping device 86 includes a mounting plate 87 and a pair of upstanding plates 88 and 89 shown only in FIG. 6. Each of the upstanding plates 88 and 89 have a plurality of laterally-spaced openings 91 and 92 therethrough which are axially aligned with each other as well as axially aligned with the openings 71 and 72 in the upstanding plates 68 and 69 on the first tube clamping device 66. A plurality of clamping blocks 93 and 94 are provided between the upstanding plates 88 and 89 as well as between side plates 96 and 97 as shown in FIG. 5. Each of the clamping blocks has a semicircular groove therein which, when the clamping blocks are in the position illustrated in FIGS. 5 and 6, form a circular opening 98. The clamping blocks 93 are supported for vertical movement between the solid line position and the broken line position illustrated in FIG. 5. A common block 99 is secured, if desired, through an equalizer pad 101 to each of the clamping blocks 93. A pair of power cylinder assemblies 102 are mounted on a top wall 103 of the second tube clamping device 86 and the reciprocal piston rods 104 thereof are secured by ay convenient means to the common block 99. The dual application of force to the common block 99 by the dual piston rods 104 assures an even application of force through the equalizer pad 101 to each of the clamping blocks 93 along the length thereof between the upstanding plates 88 and 89.

Each second tube clamping device 86 includes a pair of roller bearing guides 116 and 117 on laterally opposite sides as shown in FIG. 5, which roller bearing guides 116 and 117 operatively engage the guide tracks 63 and 64, respectively, in order to support the second tube clamping device 86 for longitudinal movement along the guide tracks 63 and 64 between a position adjacent the first tube clamping device 66 illustrated in FIG. 2 to a position engaging the plate 57 of the stop mechanism 39 when the plate 57 is in the solid line position illustrated in FIG. 8. A power cylinder assembly 118 is connected through reciprocal piston rod 121 to the second tube clamping device 86 to effect a driving of the second tube clamping device 86 between the aforementioned positions, including an intermediate position wherein the second tube clamping device 86 engages the plate 57 when the plate 57 is in the broken line position illustrated in FIG. 8. It is to be noted that the force exerted by the power cylinder assemblies 59 in the stop mechanisms 39 is sufficient to stop the movement of the second tube clamping devices 86 driven by the power cylinder assembly 118. Upon a deactivation of the power cylinder assemblies 59, the force exerted by the power cylinder assembly 118 will be sufficient to cause the plate 57 to be driven to the solid line position illustrated in FIG. 8. The importance of this particular control feature will become more evident below.

In this particular embodiment, six side-by-side tubes T are adapted to extend through openings 98. If one of the tubes should become jammed or it becomes necessary to feed a tube from a new coil of tubing through the system, it will be necessary to be able to move the second tube clamping device 86 back and forth between the first tube clamping device 66 and the stop mechanism 39 without causing movement of the tubing that may still be present in the system. In other words, it will be desirable to be able to lock the second tube holding device 86 to a selected tube and prevent the second tube clamping device from gripping the tubing yet remaining in the system. In this regard, and referring to FIG. 6, a shiftable plate 108 is provided beneath each clamping blocks 94, which plate 108 is shiftable in the directions of the arrow 109. A screw 110 with an enlarged head 111 is received into one end of the plate 108. A tool (not shown) can be placed between the plate 88 and a shoulder defined by the enlarged head 111 to pry the plate 108 to the left so that the downwardly projecting pads 112 on the underside of the plate 108 can move into the upwardly facing troughs 113 to effect a lowering of the plate 108 and also clamping block 94 from engagement with the clamping blocks 93. Since the clamping blocks 94 are urged to their clamping position by a positioning of the plate 108 in the solid line position shown in FIG. 6, movement of the plate 108 to the left to allow the pads 112 to move into the troughs 113 will cause the clamping blocks 94 to be lowered away from the solid line position illustrated in FIG. 6. Thus, when the power cylinder assemblies 102 are activated to move the clamping blocks 93 downwardly, the clamping blocks 94 which have not been moved and have been kept in the solid line position will enable the tube within that particular section of the second tube clamping device to be clamped between the clamping blocks 93 and 94. Movement of the feed clamp 86 will effect a movement of that particular tube(s) T and not any of the other tubes. When the system is ready for continued operation, the plate 108 can be moved rightwardly back to the solid line position illustrated in FIG. 6 to cause the pads 112 to rise up onto ribs 114 to urge the clamping blocks 94 back to their respective clamping position.

The side of the fixed first tube clamping device 66 remote from the movable second tube clamping device 86 defines an exit end 125 for the tubing T exiting outwardly of the first tube clamping device 66. A conventional tube cutting mechanism 123 is provided adjacent and downstream of the first tube clamping device 66. The tube cutting mechanism 123 can be of the type disclosed in either one of U.S. Pat. Nos. 3 568 488 or 3 692 219, both patents being assigned to the same assignee as the invention disclosed herein. Reference to these two patents is to be incorporated herein. Thus, further discussion concerning the nature of the tube cutting mechanism will not be described in any further detail.

In this particular embodiment, a pair of brackets 124 and 126 are mounted on lateral facing sides of the platform 26 of the carriage 23 on a side of the tube cutting mechanism 123 remote from the first tube clamping device 66 as shown in FIGS. 1A and 2A. An optical sensing circuit which includes a pair of spaced optical devices 127 and 128 are respectively mounted to the brackets 124 and 126 so as to operate along an optical path 129 extending therebetween. The optical path 129 is oriented so as to extend in a plane containing the longitudinal axes of the tubes T as well as the longitudinal axes of the aligned holes 71 and 72 in the first tube clamping device 66. If the material of the tubing T is present between the optical devices 127 and 128, the optics will be blocked and no light will be permitted to pass therebetween and this condition will serve to control a tube bending operation described in more detail below. Upon the presence of light extending between the optical devices 127 and 128 along the optical path 129, this presence of light will serve as a signal activating a tube bending operation described below.

Referring now to the tube bending mechanism 12 illustrated in FIGS. 1B and 2B, the tube bending mechanism 12 includes a table-like frame 131 having a plurality of legs 132 extending between a base structure 133 and a frame member 134 having a upwardly facing mounting surface 136 thereon. A pair of guide rails 137 and 138 are mounted on the support platform 13 and extend generally parallel to the longitudinal axis 37 described above. Four rail engaging wheels 139 support the frame 131 for movement along the length of the rails 137 and 138. A screw 141 is rotatably driven by a motor 142 mounted on the base frame 133. The screw is received in a nut 143 fixed to the frame 14 of the tube stretch straightening mechanism 11. Since the frame 14 of the tube stretch straightening mechanism 11 is fixed relative to the support platform 13, rotation of the screw 141 will cause the frame 131 to move along the rails 137 and 138 toward and away from the frame 14 on the tube stretch straightening mechanism 11. The screw 141 is rotated only during set up so as to initially orient the frame 131 at a fixed spacing from the frame 14.

A conventional tube bending device 146, such as is shown in U.S. Pat. No. 3 692 219 mentioned above, is mounted on the mounting surface 136 of the frame 131. The tube bending device 146 includes a base part 147 mounted on the mounting surface 136, which base part 147 has an axle supporting part 148 supporting a bend head 149 for movement about the axis of an axle 151. The axle 151 includes a pair of gears not illustrated which are engaged by longitudinally shiftable toothed gear racks 152, the teeth of which racks mesh with the teeth on the aforementioned gears to cause the axle 151 to rotate and move the bend head 149 in direction of the arrow 153 illustrated in FIG. 1B. A power cylinder assembly 154 includes a reciprocal piston rod 156 fastened to the reciprocal rack 152 to effect a driving movement of the racks 152 for longitudinal movement relative to the gears. Other drive mechanisms well known in the art can be employed, such as a Rotac unit manufactured by The Cadillac Gage Division of Ex-Cell-0 Corporation of Greenville, Ohio. A bend head clamp 157 is mounted on the bend head 149 and is of a conventional variety not necessitating further discussion. It will be mentioned, however, that the bend head clamp 157 is similar to the first tube clamping device 66 and includes a plurality of side-by-side holes axially aligned with the longitudinal axes of each of the tubes T exiting the tube stretch straightening mechanism 11. The tubes enter the holes through the bend head clamp 157 in a conventional manner and once the appropriate length of tubing has exited the tube stretch straightening device 11 and enter the tube bending device 146, the bending head clamp 157 will fixedly clamp the tubing in place.

The tube bending device 146 is operative to bend the tubing T to a required angle so as to compensate for any residual elastic spring back of the legs of the hairpin and to cause the legs to become generally parallel, it being recognized that the final orientation of the legs can be at any desired relation to facilitate the manual lacing task of the tubes into a stack of fins. For example, it may be more convenient for the lacing personnel to have the final orientation of the legs of the hairpin at a slight acute angle of approximately 1° to 3° to enable the lacer to grasp the legs of a tube in the hand and squeeze them toward one another to align the legs of the hairpin with the stamped holes in the fin stack.

Figure 10:
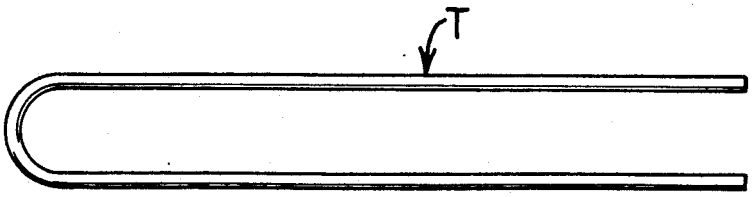
FIG. 10 is a view of a U-tube made by the combination stretch straightening and tube bending device.

Synchronization of the operative sequences of the tube straightening device 11 and the tube bending mechanism 12 are controlled by circuitry in a control circuit located in a cabinet 158. A separate control panel 159 is provided for enabling a manual control of all of the functions on both the tube stretch straightening mechanism 11 and the tube bending mechanism 12. A multitude of control circuit possibilities exist for effecting the desired control. Rather than disclose a specific circuit for accomplishing the task, FIGS. 9A and 9B set forth a flow diagram showing the sequencing of steps that occur to effect an operation of the overall tube stretch straightening and tube bending device 10 to produce a U-shape bent tube T as shown in FIG. 10.

Switches are required on the tube stretch straightening and tube bending device 10 in order to facilitate a proper controlling of the sequential operation. More specifically, a pressure switch 171 is provided on the hold clamp 66 in order to detect whether full pressure has been attained at the power cylinder assemblies 81 to effect a complete clamping of the tubing within the associated clamping device 73, 74. A similar pressure switch 172 is provided on the power cylinder assemblies 102 in order to indicate whether sufficient pressure is present to effectively clamp a tube T within the feed clamp 86. Referring to FIG. 8, a stretch completed proximity switch 173 is provided on the plate 41, which proximity switch detects the presence of the plate 57 when it is in the solid line position illustrated in FIG. 8. When the feed clamp 86 is moved in the feed direction, namely, to the right as illustrated in FIG. 2A, a forward deceleration proximity switch 174 is provided on the tracks 32 and 33 to detect the presence of the feed clamp 86 and issue a signal indicating that the movement of the feed clamp is to be decelerated. A feed stop proximity switch 176 is mounted downstream of the deceleration switches 174 to effectively detect that the feed cylinder 118 has fully extended. The shifting movement of the carriage 23 relative to the frame 18 is monitored by a pair of proximity switches 177A and 177B (FIG. 1A). The switch 177A indicates that the carriage 23 has moved to the left in FIG. 1A to retract the cutting mechanism 123 away from the bending mechanism 12. The switch 177B indicates that the carriage 23 has moved to the right in FIG. 1A to place the cutting mechanism 123 adjacent the bending mechanism 12. Once the proximity switches 177 have detected such movement, an appropriate switching signal is established.

When the feed clamp 86 moves in a retracted direction, namely, to the left in FIG. 2A, its movement is generally at a high speed until its presence is detected by a rear deceleration switch 178 mounted on the tracks 32 and 33. The presence of the feed clamp 86 will be detected by the proximity switch 175 which signals that the feed clamp 86 has retracted to the extended or broken line position of 57 shown in FIG. 8. In turn, a series of signals will be sent to clamp the feed clamp 86, deenergize the power cylinders 59, high pressure further retract the feed clamp 86 for stretching of the tubes followed by a reopening and closing of the feed clamp to relax the tubes after the proximity switch 173 is made. Lastly, a bend return switch 179 is provided on the bending mechanism as illustrated in FIG. 1B to indicate that the bend head has returned to the initial position shown in FIG. 1B thereafter allowing movement of unbent tubing into the tube bending mechanism 12. Other switches can be provided to accomplish other tasks. However, the above switching facilitates an operative sequence of the tube stretch straightening and tube bending device 10 as will be explained in more detail below.

OPERATION

Although the operation of the overall structure described above will be understood from the foregoing description by skilled persons, a summary of such description will not be given or convenience.

Figure 9A:
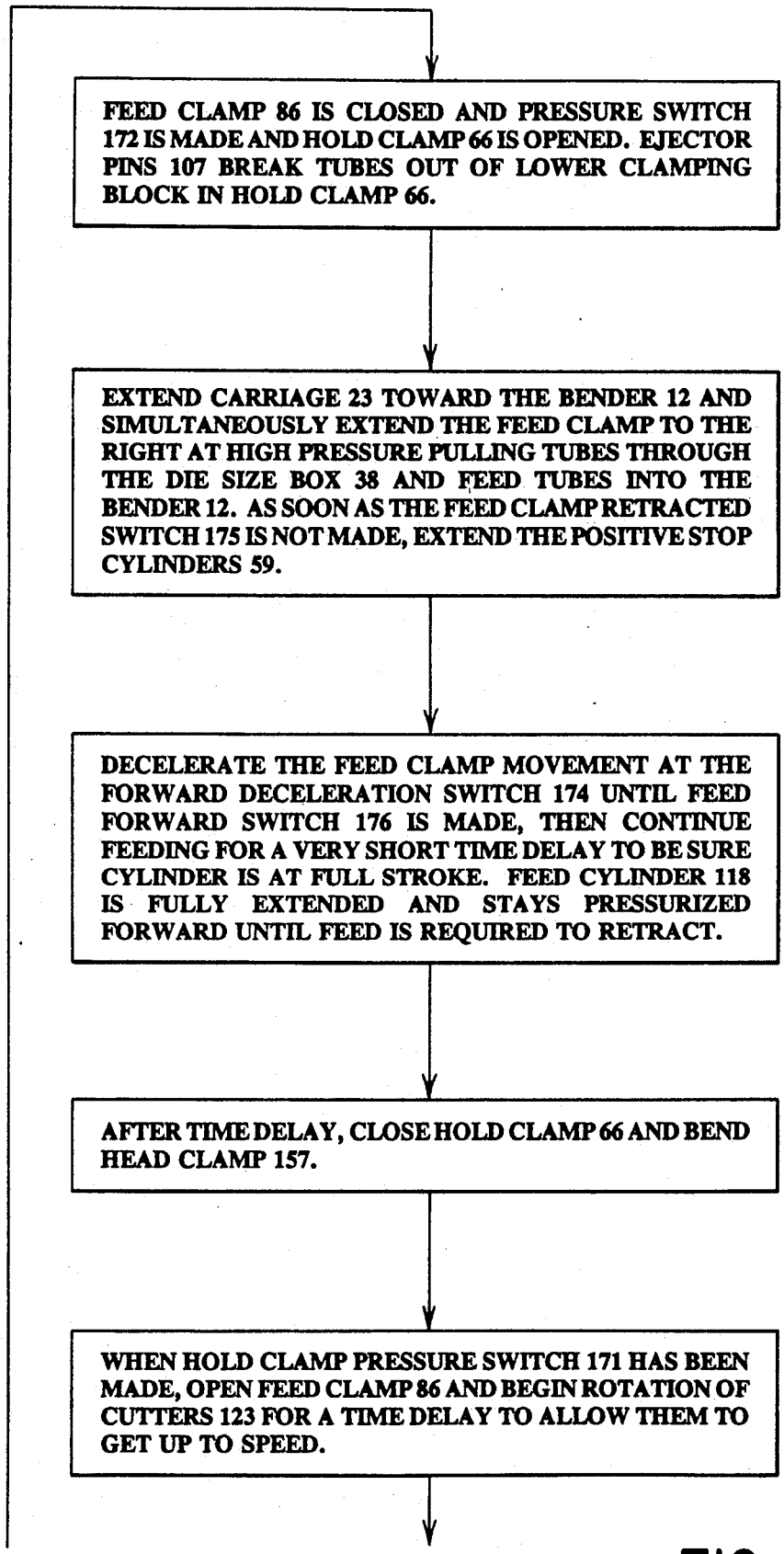
FIGS. 9A and 9B show a block diagram setting forth the sequence of operation provided by a control mechanism for the combination tube stretch straightening and tube bending device.
Figure 9B:
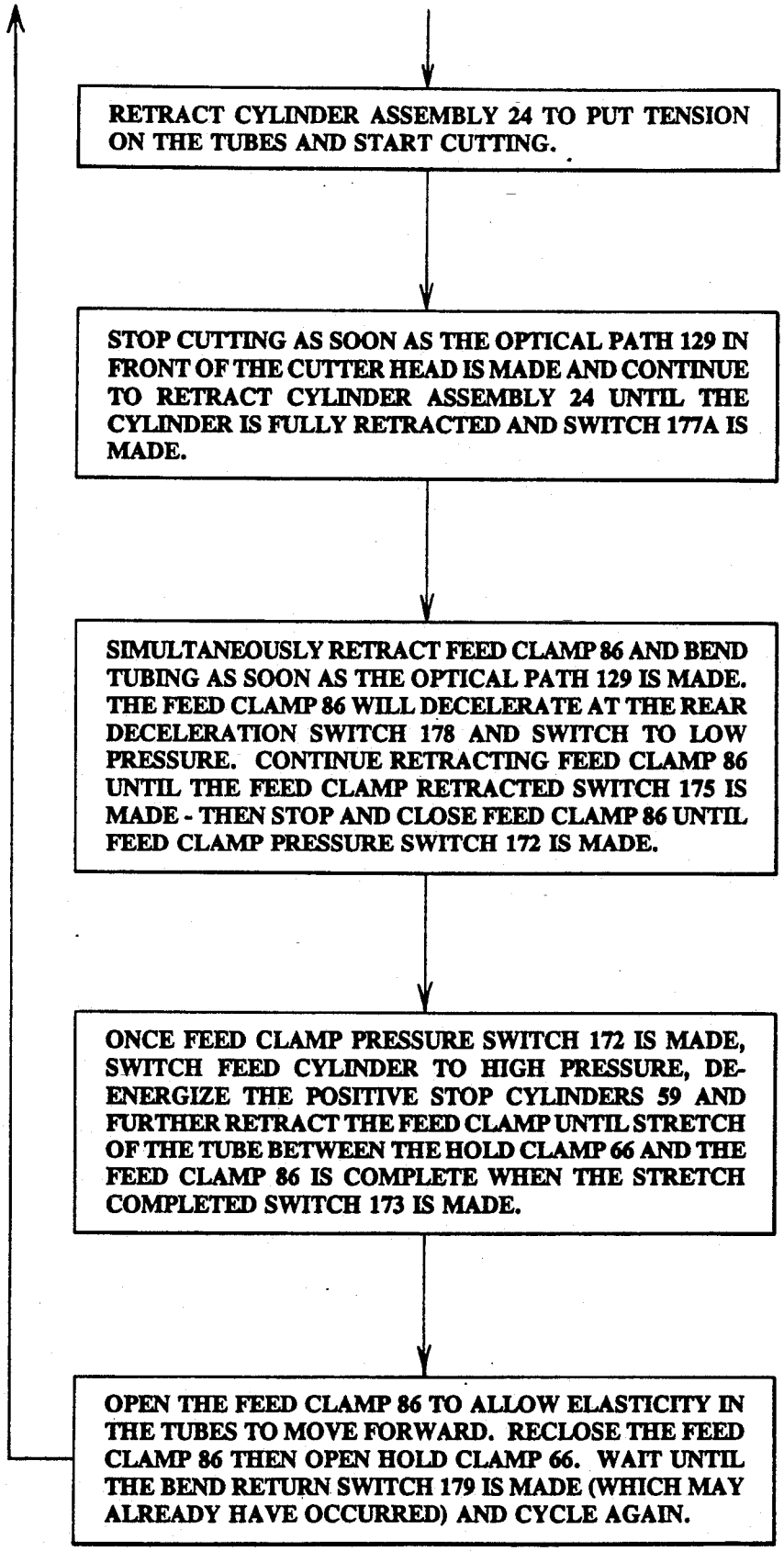

FIGS. 9A and 9B set forth the operative sequence that occurs in order to effect a tube stretch straightening task, a cutting of the tube to a prescribed length and thereafter bending the prescribed length of tube at the midpoint thereof into a U-shape as shown in FIG. 10. The initial setup includes operation of the motor 142 and a turning of the screw 141 relative to the nut 143 to adjust the initial spacing between the tube stretch straightening mechanism 11 and the tube bending mechanism 12. The adjusted stroke of the feed clamp 86, determined by the positioning of the stop mechanism 39, will determine the length of tubing ejected from the tube stretch straightening mechanism 11 at the exit as well as the length of tubing inserted into the tube bending mechanism 12. Once the appropriate spacing has been determined and the stop mechanism 39 appropriately positioned, the sequencing of FIGS. 9A and 9B can be activated. Referring to FIG. 2A, and assuming that the feed clamp 86 is in a position adjacent the stop mechanism 39, the feed clamp 86 is first closed and when the pressure switch 172 indicates that sufficient pressure is present to assure a proper clamping of the tubing in the feed clamp 86, everything is made ready to move the feed clamp 86 in the feed direction. However, and prior to this movement, the hold clamp 66 is opened and any tubing that may be constricted therein is ejected by activating the ejector pins 107 to free the tubes out of the lower clamping block 74 in the hold clamp 66. At this moment, the power cylinder assembly 24 is activated o cause the carriage 23 to move toward the tube bending mechanism 12, namely, to the right in FIG. 1A to make the switch 177B. Simultaneous with a movement of the carriage 23 toward the tube bending mechanism 12, the power cylinder assembly 118 is activated to move the feed clamp 86 to the right in the feed direction at a high pressure to effect a pulling of tubing from a coiled tube supply located to the left of the tube entrance 27 illustrated in FIG. 2A through the die size box 38 and, if tubing is present in front of the feed clamp 86, push tubing through the hold clamp 66 into the tube bending mechanism 12. The positive stop cylinders 59 are extended to move the plate 57 (FIG. 8) to the broken line position. This causes the stretch completed proximity switch 173 to open. Subsequently, the feed clamp 86 will reach the forward deceleration switch 174 and when this switch detects the presence of the feed clamp 86, further movement of the feed clamp will be at a decelerated speed until the forward proximity switch 176 detects the presence of the feed clamp 86. Pressure remains on the power cylinder assembly 118 to hold each power cylinder assembly at full stroke. After an appropriate time delay, the hold clamp 66 is closed and the bend head clamp 157 on the tube bending mechanism 12 is closed. When the hold clamp pressure switch 171 indicates that sufficient pressure is present effecting a clamping of the tubing in the hold clamp 66, the feed clamp 86 is opened and the cutter mechanism 123 is operated to rotate the cutters therein for a certain time period to allow the cutters to get up to speed. Prior to the cutters engaging the tubing in order to effect a cutting thereof, the power cylinder assembly 24 is activated to retract the carriage 23 in a leftwardly direction illustrated in FIG. 1A to apply tension to the section of tubing that extends between the hold clamp 66 and the bend head clamp 157. Once this tension has been applied to the tubing, the cutting mechanism 123 can then begin cutting the tubing. As soon as the cutting operation cuts through the tubing, the tension applied to the tubing by the retracted carriage 23 will cause the break between the severed tubing to be clean, i.e., no inwardly rolled edges. Further, the carriage 23 will suddenly move away from the tube bending mechanism 12 and as this happens, the optical path 129 will be made, namely, light will be detected between the optical heads 127 and 128. At this point in time, the cutting mechanism 123 will be deactivated, the feed clamp 86 will be retracted, the switch 177A will be made to indicate a fully retracted carriage 23 and the tube bending operation will be occurring simultaneously. That is, the power cylinder assembly 154 will be activated to effect a turning of the bend head clamp about the axle 151 in the direction of the arrow 153 to bend the tubing into a U-shape as shown in FIG. 10. The feed clamp 86, as stated above, is being retracted during this period of time toward the stop mechanism 39. During this period of time, the feed clamp 86 is deactivated, namely, it is not clamped to any tubing and, as a result, the feed clamp 86 is moving in the retracted direction while the tubing extending between the die size block 38 and the hold clamp 66 remains stationary. The feed clamp 86 will continue to move in the retracting direction until its presence is detected by the rear deceleration switch 178. At this retracting moment in time, the power cylinder assembly 118 is switched to a low pressure, slow speed. The feed clamp 86 continues to move at low pressure, slow speed until its presence is detected by the proximity switch 175 which indicates that the feed clamp 86 has reached the extended location (shown in broken lines in FIG. 8) of the plate 57. Thereafter, the feed clamp 86 is closed. When the feed clamp pressure switch 172 indicates that sufficient pressure is present to lock the tubes T in the feed clamp 86, the power cylinder assembly 118 is switched to high pressure and simultaneously therewith the positive stop cylinders 59 are de-energized to enable the feed clamp to move further in the retracting direction to stretch the section of tubing clamped between the now closed hold clamp 66 and the closed feed clamp 86 to effectively stretch straighten the aforesaid section of tubing. The stretch straightening task is complete when the switch 173 detects the presence of the plate 57. Since the feed clamp 86, while effectively clamped to the tubing T is moved in the retracting direction, namely, to the left in FIG. 2A, tubing that is present in the tube sizing dies 38 is actually shifted leftwardly, namely, toward the source of tubing. Since the tube sizing dies 38 are reciprocally supported on guide bars 40, the tube sizing dies 38 will also be allowed to shift leftwardly to accommodate a pushing movement applied to the tubing by the feed clamp 86 as it moves the short distance represented by the broken line position of the plate 57 in FIG. 8 and the solid line position thereof. The power cylinder assembly 118 will stay activated in the retract mode until it is required to feed forward again. After a certain time delay, the feed clamp 86 is opened. Any tension accumulated in the stretched tubing will be allowed to relax at this point without disturbing the positioning of the tubing held by the hold clamp 66 or the length of tubing present in the tube cutting mechanism 123. That is, the release of the tubing from the feed clamp 86 will cause a small incremental forward movement of the tubing from the tube supply relative to the feed clamp. Since the tube movement is sudden, the tube sizing dies 38 will slide forwardly on the guide rods 40 as this movement occurs so as to avoid an over stressing of the tubing. A further time delay may be necessary in order to wait for the bend return switch 179 to be activated, indicating that the tube bending mechanism 12 is ready to receive additional tubing. If the bend return switch 179 has already been activated, the system is ready to cycle again.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A tube stretch straightening and tube bending device, comprising:

a frame means;

elongated and straight track means on said frame means for guiding at least one elongated continuous tube the length of said frame means, said track means having a tube entrance for a continuous length of tube at one end and a tube exit at an opposite end;

a first tube holding means fixedly positioned on said frame means adjacent said tube exit and having releasable first clamping means thereon for releasably gripping and fixedly holding the tube thereto;

a second tube holding means movably guided along said track means between a first position adjacent said first tube holding means and a second position adjacent said tube entrance, said second tube holding means having releasable second clamping means thereon for releasably gripping and holding the tube thereto;

shiftable stop means at a third position of said second tube holding means intermediate said first and second positions, said stop means being in the path of movement of said second tube holding means, being reciprocally shiftable along said track means between said second and said third positions of said second tube holding means, and being adapted for controlling the final increment of travel of said second tube holding means during a movement of said second tube holding means from said third position toward said second position;

tube cutting means adjacent said tube exit and said first tube holding means and aligned with said track means for severing the tube;

tube bending means adjacent said tube cutting means and aligned with said track means, said tube bending means being on a side of said tube cutting means remote from said first tube holding means; and control means (1) for facilitating an activation of said first clamping means to grip and hold the tube to said first tube holding means while simultaneously effecting a movement of said second tube holding means, when said second clamping means is deactivated, toward said second position until contact with said stop means at said third position occurs, (2) for activating said second clamping means while said second tube holding means is at said third position to grip and hold the tube to said second tube holding means, (3) for shifting the position of said shiftable stop means from said third position to said second position to allow for the movement of said second tube holding means from said third position to said second position, a finite length of said tube between said first tube holding means and said second position of said second tube holding means being stretched straightened as said second tube holding means is moved from said third position to said second position, and (4) for deactivating of said second clamping means following an arrival of said second tube holding means at said second position to release the stresses in the material of said tube caused by the stretch straightening of said tube, followed by a reactivation of said second clamping means and a deactivating of said first clamping means and effecting a movement of said second tube holding means and said finite length of said tube toward said first position causing said finite length of said tube to exit said track means and enter said tube bending means whereby said tube cutting means severs said tube followed by said tube bending means effecting a bending of said finite length of said tube, whereupon said tube straightener and bender is positioned for another cycle of operation.

2. The tube stretch straightening and tube bending device according to claim 1, wherein said frame means includes a main frame and a carriage and support means for supporting said carriage for reciprocal movement on said main frame in a direction parallel to said track means, wherein first reciprocal drive means is provided for effecting said reciprocal movement of said carriage means, said carriage means supporting thereon said track means, said first and second tube holding means, said shiftable stop means, said tube cutting means and said tube bending means for reciprocal movement therewith.

3. The tube stretch straightening and tube bending device according to claim 2, wherein said second tube holding means includes a second reciprocal drive means for effecting said movement of said second tube means along said track means.

4. The tube stretch straightening and tube bending device according to claim 3, wherein said shiftable stop means includes an abutment member and guide means for guiding said abutment member for reciprocal movement between said second and third positions, wherein a third reciprocal drive means is provided for effecting said movement of said abutment member between said second and third positions.

5. The tube stretch straightening and tube bending device according to claim 2, wherein said frame means further includes a secondary frame separate from said main frame, said carriage means being reciprocal toward said secondary frame to a fourth position and away from said secondary frame to a fifth position.

6. The tube stretch straightening and tube bending device according to claim 5, wherein said carriage means is initially urged by said first reciprocal drive means to said fourth position, wherein said tube bending means includes a third tube holding means which has a releasable third clamping means thereon for releasably gripping and fixedly holding the tube thereto, wherein said control means further effects an activation of said third clamping means to cause said tube to become fixedly clamped to said third tube holding means whereupon, and while said first clamping means is activated to fixedly clamp the tube thereto, said first reciprocal drive means is activated to urge said carriage means toward said fifth position to tension a portion of the tube extending between said first and third tube holding means, said tube cutting means effecting said severing of the tube, said tension on the tube causing the tube to be cleanly severed, said carriage means completing its movement to said fifth position following said severing of the tube.

7. The tube stretch straightening and tube bending device according to claim 6, wherein said control means includes a sensing means for sensing a gap between the severed components of the tube and for effecting a bending of a tube portion in said tube bending means in response to a sensing of a gap by said sensing means.

8. The tube stretch straightening and tube bending device according to claim 1, including a tube sizing die mounted on the track means for transforming the outer diameter of the tubing as it passes therethrough to an outer diameter having a precise outer diameter dimension.

9. The tube stretch straightening and tube bending device according to claim 8, wherein said tube sizing die is mounted for reciprocal movement on guide rods provided on the frame means and for movement between prescribed limits.

10. The tube stretch straightening and tube bending device according to claim 1, wherein said second tube holding means includes shiftable clamp deactivating means rendering selected portions of said second tube holding means unable to effectively clamp tubing therein to facilitate movement of the second tube holding means relative to tubing extending therethrough and during a time that the releasable second clamping means is activated for gripping and holding the tube therein.

11. A tube stretch straightening and tube cutting device, comprising:

a frame means;

elongated and straight track means on said frame means for guiding at least one elongated continuous tube the length of said frame means, said track means having a tube entrance for a continuous length of tube at one end and a tube exit at an opposite end;

a first tube holding means fixedly positioned on said frame means adjacent said tube exit and having releasable first clamping means thereon for releasably gripping and fixedly holding the tube thereto;

a second tube holding means movably guided along said track means between a first position adjacent said first tube holding means and a second position adjacent said tube entrance, said second tube holding means having releasable second clamping means thereon for releasably gripping and holding the tube thereto;

shiftable stop means at a third position of said second tube holding means intermediate said first and second positions, said stop means being in the path of movement of said second tube holding means, being reciprocally shiftable along said track means between said second and said third positions of said second tube holding means, and being adapted for controlling the final increment of travel of said second tube holding means during a movement of said second tube holding means from said third position toward said second position;

tube cutting means adjacent said tube exit and said first tube holding means and aligned with said track means for severing the tube; and control means (1) for facilitating an activation of said first clamping means to grip and hold the tube of said first tube holding means while simultaneously effecting a movement of said second tube holding means, when said second clamping means is deactivated, toward said second position until contact with said stop means at said third position occurs, (2) for activating said second clamping means while said second tube holding means is at said third position to grip and hold the tube to said second tube holding means, (3) for shifting the position of said shiftable stop means from said third position to said second position to allow for the movement of said second tube holding means from said third position to said second position, a finite length of said tube between said first tube holding means and said second position of said second tube holding means being stretched straightened as said second tube holding means is moved from said third position to said second position, and (4) for deactivating of said second clamping means following an arrival of said second tube holding means at said second position to release the stresses in the material of said tube caused by the stretch straightening of said tube, followed by a reactivation of said second clamping means and a deactivating of said first clamping means and effecting a movement of said second tube holding means and said definite length of said tube toward said first position causing said finite length of said tube to exit said track means whereby said tube cutting means severs said tube, whereupon said tube straightener is positioned for another cycle of operation.

12. The tube stretch straightening and tube cutting device according to claim 11, wherein said frame means includes a main frame and a carriage and support means for supporting said carriage for reciprocal movement on said main frame in a direction parallel to said track means, wherein first reciprocal drive means is provided for effecting said reciprocal movement of said carriage means, said carriage means supporting thereon said track means, said first and second tube holding means, said shiftable stop means and said tube cutting means for reciprocal movement therewith.

13. The tube stretch straightening and tube cutting device according to claim 12, wherein said tube holding means includes a second reciprocal drive means for effecting said movement of said second tube means along said track means.

14. The tube stretch straightening and tube cutting device according to claim 13, wherein said shiftable stop means includes an abutment member and guide means for guiding said abutment member for reciprocal movement between said second and third positions, wherein a third reciprocal drive means is provided for effecting said movement of said abutment member between said second and third positions.

15. The tube stretch straightening and tube cutting device according to claim 11, including a tube sizing die mounted on the track means for transforming the outer diameter of the tubing as it passes therethrough to an outer diameter having a precise outer diameter dimension.

16. The tube stretch straightening and tube cutting device according to claim 15, wherein said tube sizing die is mounted for reciprocal movement on guide rods provided on the frame means and for movement between prescribed limits.

17. The tube stretch straightening and tube cutting device according to claim 11, wherein said second tube holding means includes shiftable clamp deactivating means rendering selected portions of said second tube holding means unable to effectively clamp tubing therein to facilitate movement of the second tube holding means relative to tubing extending therethrough and during a time that the releasable second clamping means is activated for gripping and holding the tube therein.

* * * * *

UNITED STATES PATENT AND TRADEMARK OFFICE

CERTIFICATE OF CORRECTION

PATENT NO. : 5,233,853

DATED : August 10, 1993

INVENTOR(S) : James G. MILLIMAN

It is certified that error appears in the above-identified patent and that said Letters Patent is hereby corrected as shown below:

Column 15, line 46; change "of" to ---to---.

Column 16, line 11; change "definite" to ---finite---.

line 29; after "said" insert ---second---.

Signed and Sealed this

Twelfth Day of April, 1994

*Attest:*

*Attesting Officer*

BRUCE LEHMAN

*Commissioner of Patents and Trademarks*